US011751305B2

(12) United States Patent
Schmitz

(10) Patent No.: US 11,751,305 B2
(45) Date of Patent: Sep. 5, 2023

(54) BIOLOGICALLY SAFE CONTROL OF LED LAMPS

(71) Applicant: Elmos Semiconductor SE, Dortmund (DE)

(72) Inventor: Christian Schmitz, Castrop-Rauxel (DE)

(73) Assignee: Elmos Semiconductor SE, Dortmund (DE)

( * ) Notice: Subject to any disclaimer, the term of this patent is extended or adjusted under 35 U.S.C. 154(b) by 0 days.

(21) Appl. No.: 17/545,586

(22) Filed: Dec. 8, 2021

(65) Prior Publication Data

US 2022/0183123 A1 Jun. 9, 2022

(30) Foreign Application Priority Data

Dec. 9, 2020 (DE) ..... 10 2020 132 878.8

(51) Int. Cl.
*H05B 45/325* (2020.01)
*H05B 45/14* (2020.01)

(52) U.S. Cl.
CPC ..... *H05B 45/325* (2020.01); *H05B 45/14* (2020.01)

(58) Field of Classification Search
None
See application file for complete search history.

(56) References Cited

U.S. PATENT DOCUMENTS 7,284,025 B2 * 10/2007 Sullivan ..... G06F 1/0328 708/271
8,440,899 B1 * 5/2013 Bowser ..... H05B 47/18 84/609
10,172,197 B1 * 1/2019 Gao ..... H05B 45/385
(Continued)

FOREIGN PATENT DOCUMENTS

DE 102011076692 A1 * 12/2011 ..... G06F 7/602
DE 102011076692 B4 11/2014
(Continued)

OTHER PUBLICATIONS

German Office Action dated Aug. 12, 2021 re DE102020132878.8 (10 pages).

*Primary Examiner* — Harshad C Patel
*Assistant Examiner* — Syed M Kaiser
(74) *Attorney, Agent, or Firm* — MINDFUL IP PLLC; Michael J McCandlish

(57) ABSTRACT

A control signal for controlling a light emitting device is PWM modulated in time, the PWM modulation comprising PWM pulses and PWM periods. The PWM pulse instantaneous frequency of a PWM pulse is the reciprocal of the instantaneous PWM period of the PWM pulse. The PWM pulse instantaneous frequency depends on the PWM duty cycle of the PWM pulses of the control signal. The PWM pulse instantaneous frequency of the PWM pulses is a first PWM pulse instantaneous frequency at a first PWM duty cycle of the control signal, and is a second PWM pulse instantaneous frequency at a second PWM duty cycle of the (Continued)

control signal. In an operating condition, the first PWM duty cycle is less than the second PWM duty cycle and the first PWM pulse instantaneous frequency is less than the second PWM pulse instantaneous frequency.

6 Claims, 1 Drawing Sheet

(56) References Cited

U.S. PATENT DOCUMENTS

| | | | | |
|---|---|---|---|---|
| 2005/0134330 | A1* | 6/2005 | Sullivan | G06F 1/0328 327/105 |
| 2012/0049743 | A1* | 3/2012 | Moskowitz | H05B 45/20 315/149 |
| 2012/0139442 | A1* | 6/2012 | Soleno | H05B 45/10 315/294 |
| 2012/0217892 | A1* | 8/2012 | Chu | H05B 45/50 315/250 |
| 2014/0354170 | A1* | 12/2014 | Gredler | H05B 45/375 315/224 |
| 2016/0057823 | A1* | 2/2016 | Pope | H05B 45/375 315/210 |

FOREIGN PATENT DOCUMENTS

| | | | | |
|---|---|---|---|---|
| DE | 102019132488 | B3 * | 12/2020 | G01S 15/104 |
| DE | 102019132488 | B3 | 12/2020 | |
| JP | 2014148253 | A * | 8/2014 | |

* cited by examiner

BIOLOGICALLY SAFE CONTROL OF LED LAMPS

CROSS-REFERENCE TO RELATED APPLICATIONS

This application claims priority to German Patent Application 10 2020 132 878.8 filed on Dec. 9, 2020, the contents of which are incorporated into the subject matter of the present application by reference.

TECHNICAL FIELD

The disclosure is directed to an LED light using light emitting diodes (LEDs) as illuminants, which minimizes the risks of IEEE 1789-2015 while providing good intensity adjustment and diagnostic capability.

BACKGROUND

IEEE 1789-2015, referenced here, reports health risks associated with the use of PWM-controlled LED drivers.

According to the current state of the art, LEDs are controlled by means of PWM-controlled constant current source. The advantage of this method is a minimal color shift of the color impression of the light of the luminaire emitted by the LED as illuminant, as the LED current is not modulated.

In the IEEE 1789-2015 standard, this modulation type is described and referred to as 100% modulation.

Depending on the technical possibilities of the LED drivers and PWM generators used, a PWM pulse instantaneous frequency above 100 Hz is used. The IEEE 1789-2015 standard recommends a PWM pulse instantaneous frequency greater than 2000 Hz for the modulation type used. According to the current state of the art, LEDs are driven by PWM-controlled constant current sources. A constant current source drives an illuminant with an electric current which is adjusted to a predetermined current value by design or by means of a control value signal. The illuminant thereby typically comprises an LED or an LED string comprising one or more LEDs connected in series, or a parallel connection of several LED strings. Preferably, the constant current source is switched on and off in a pulse-like repetitive manner using a PWM period. Thus, when the constant current source is on for a PWM pulse duration during a PWM period, the constant current source only feeds that preset current into the illuminant at on times for that PWM pulse duration. For the remainder of the PWM period outside of the PWM pulse duration, the constant current source therefore typically does not feed any current into the illuminant. When the constant current source injects the preset amount of electrical current into the illuminant during the PWM pulse period, the constant current source supplies electrical energy to the illuminant during the PWM pulse period, thereby causing the illuminant to emit light. The preset amount of electric current influences the color perception, i.e., the color temperature, of the emitted light by a human being. The advantage of this method is minimal color shift because the preset value of the LED current is not modulated. The illuminant is either on or off. Depending on the technical possibilities of the LED drivers and PWM generators used as illuminant drivers, a PWM pulse instantaneous frequency above 100 Hz is used to avoid unwanted flickering effects on the viewer. A PWM modulation of the control signal used by the illuminant driver to supply electrical energy to the illuminant, in this case the LEDs, therefore exhibits PWM pulses. For the purpose of this paper, for better clarity, each PWM pulse is associated with exactly one PWM period and, conversely, each PWM period is associated with exactly one PWM pulse in order to be able to precisely define the PWM pulse instantaneous frequency. The PWM modulation of the power supply to the illuminating means by said constant current source has, for the purposes of this writing, PWM periods respectively associated with the PWM pulses. Such a PWM period of a PWM pulse starts in terms of time with the rising edge of the PWM pulse and ends with the rising edge of the immediately following PWM pulse of the PWM modulation. For the purposes of this writing, the PWM pulse instantaneous frequency of a PWM pulse is then the reciprocal of the PWM period of that PWM pulse. Furthermore, for the purposes of this writing, the PWM duty cycle of a PWM pulse is understood to be the ratio of the value of the temporal duration of a PWM pulse in a PWM period of the PWM modulation of the control signal divided by the value of the temporal PWM period duration of this PWM period of the PWM modulation of the control signal.

For example, a PWM pulse instantaneous frequency of 300 Hz is typically used in the field of RGB interior lighting for automobiles at the time of this writing. PWM pulse instantaneous frequencies above 500 Hz are now being discussed. However, increasing the PWM pulse instantaneous frequency encounters technical limitations, since the minimum current source active time in which the respective illuminant driver of the respective LED supplies energy to the LED in question is in the nanosecond range at the typically required 16-bit resolution of the PWM duty cycle. However, an LED cannot be driven with this short PWM pulse duration due to parasitic capacitances. Furthermore, the error of the intensity setting increases due to the non-ideal edge shape.

At the same time, the lower active time makes diagnosis more difficult. This is understood to mean a measurement of the operating parameters of the LED or the LED string during operation in order to detect faults, such as already existing interruptions or indications of such developing interruptions or short circuits or developing short circuits, for example, by detecting the LED current and/or the LED voltage and their time characteristics.

Current illuminant drivers use PWM generators based on configurable PWM clock generators and/or duty cycle timers. The basis of a PWM generator is usually a counter that is operated with a PWM clock and that restarts cyclically with the current PWM period. This restart is typically triggered by a reset logic of the PWM counter at a first count of the PWM counter. The exemplary PWM counter then jumps back to the restart value. For example, upon the PWM counter restarting and/or the PWM counter taking the PWM counter restart value, the PWM counter may turn on the constant current source to supply electrical power to the illuminant. At a second count value, which is typically taken between the restart value and the first count value by the PWM counter, the PWM counter typically switches the constant current source off again, so that until the first count value is taken by the PWM counter, the illuminant no longer emits light. The first number of counting steps of the PWM counter between taking the restart value of the PWM counter and taking the first counting state of the PWM counter divided by the PWM clock typically corresponds to the PWM period. The second number of counting steps of the PWM counter between taking the restart value of the PWM counter and taking the second counting state of the PWM counter divided by the PWM clock typically corresponds to the PWM pulse period. However, in addition to such a PWM generator based on a PWM counter, other PWM generators are conceivable, the use of which is claimed herein. The setting of the PWM frequency is typically only possible by means of integer dividers. If a PWM pulse instantaneous frequency is desired which cannot be generated as an integer from the PWM clock with which the PWM generator in the illuminant driver is operated, the PWM resolution of the PWM modulation of the control signal of the illuminant driver with which the illuminant driver supplies the illuminant with electrical energy from the illuminant driver is reduced.

A problem now arises from the fact that the respective illuminant cannot be switched on and off arbitrarily fast. Firstly, the electric current through the illuminant shows a typically exponential increase when switched on and a typically exponential decrease when switched off. Thus, at least the temporal course of the light intensity emitted by the illuminant exhibits a low-pass behavior compared to the ideal control signal that the respective illuminant driver PWM-modulates to provide power to the illuminant. This low-pass behavior and the typically non-linear characteristic of the illuminant lead to a non-linear distortion of the light intensity for small light intensities, since the short PWM pulses due to the low-pass characteristic and the non-linear characteristic of the illuminant then lead to a change in the light emission of the illuminant, the change in intensity of which is no longer proportional to the change in the temporal PWM pulse duration.

A fundamental increase of the PWM pulse instantaneous frequency to values above 500 Hz would thus cause a significant non-linearity of the rms current in the lower dimming range, i.e., in the range of low luminous intensities, which is unknown from the point of view of the application software, since the edge control by the illuminant drivers causes an increasing error at the short PWM pulses in this range, as described.

In current implementations, the use of a PWM frequency higher than 2000 Hz would mean a significant reduction of the PWM resolution or would require a very high clock frequency PWM clock of the PWM generator, e.g., a PWM counter.

SUMMARY

The proposal is therefore based on the task of creating a solution which does not have the above disadvantages of the prior art and has further advantages. This task is solved by a device according to an independent claim for a luminaire and an independent claim for a method.

A method is proposed which allows the PWM frequency of PWM-controlled light sources to be increased while avoiding short pulse times in order to enable diagnosis and reduce the influence of edges on dimming, i.e., intensity adjustment by means of an externally transmitted default value.

In an example, the method allows a light intensity-dependent adaptive PWM pulse instantaneous frequency. This corresponds to an adaptation of the instantaneous PWM period to the instantaneous light intensity to be emitted.

Typically, the luminaire receives a preset value for the light intensity to be emitted from outside. This results in a duty cycle of the PWM modulation of the control signal with which the light source driver supplies the light source with electrical energy. The illuminant driver preferably comprises the PWM generator which generates the PWM modulation.

In an example, the illuminant driver comprises a first calculation device which determines the PWM period to be set from the preset value. This first determination can be made, for example, by calculation, for example in a microcomputer of the illuminant driver, or by using a correspondence table in a memory of the illuminant driver, or by a constructively predetermined logic.

In an example, the illuminant driver comprises a second calculation device which determines the PWM duty cycle to be set from the preset value. This second determination can be made, for example, by calculation, for example in a microcomputer of the illuminant driver, or by using a correspondence table in a memory of the illuminant driver, or by a constructively predetermined logic.

In a further example, at least either a first calculation device of the illuminant driver performs the first determination or a second calculation device of the illuminant driver performs the second determination, so that at least either the duty cycle of the PWM modulation of the control signal and/or the PWM period of the PWM modulation of the control signal is corrected according to the non-linear distortion of the light emission by the illuminant.

The illuminant driver then uses the PWM period and/or the PWM duty cycle determined in this way, if applicable, to generate the control signal PWM-modulated with these values to supply the illuminant with electrical energy.

IEEE 1789-2015 reports negative physiological effects whose impact depends on the light intensity. At high light intensities, the negative effects are larger than at low intensities. This property allows the PWM pulse instantaneous frequency to be selected very high at high intensities (=large duty cycle) and smaller at low intensities (=small duty cycle). Thus, when using DDS PWM generators (see also, for example, U.S. Pat. No. 7,284,025 B2), it is possible to use adaptive PWM pulse instantaneous frequency control as a function of the configured duty cycles, i.e. the duty cycle to be configured, in the range of, for example, 100 Hz (lower limit for avoiding perceptible flicker of the illuminant, i.e. the LED) and thus to minimize the health risks far beyond the 2 kHz mentioned in the IEEE. The minimum temporal PWM pulse durations can be extended by the reduced PWM pulse instantaneous frequency, so that the influence of the edge time is minimized, since the magnitude of the ratio of the magnitude of the temporal PWM pulse duration divided by the magnitude of the temporal PWM period duration remains constant by extending the temporal PWM period duration. However, the temporal ratio of the edges within a PWM period decreases.

It is proposed to establish a method that allows adaptive PWM pulse instantaneous frequency.

At high light intensities, the resulting temporal PWM pulse durations of the PWM pulses are sufficiently long in time so that the edge influence of the PWM pulses can be neglected, since the temporal duration of the edge rise or fall is small in total compared to the respective PWM pulse duration.

At low light intensities, the resulting temporal PWM pulse durations of the PWM pulses are so short in time that the edge influence can now no longer be neglected, since the temporal duration of the edge rise or fall relative to the respective PWM pulse duration is in sum large or at least relevant. However, at these low light intensities, the PWM pulse instantaneous frequency can now be selected lower, for example via said correspondence table or said logic of the first, so that the minimum PWM pulse durations in which the illuminant driver supplies energy to the illuminant at a temporal piece are extended by the low PWM pulse instantaneous frequency. Preferably, a minimum PWM pulse duration is not undercut. Alternatively or complementarily, at these low light intensities, the PWM period can be selected higher (i.e., longer), for example via said correspondence table or said logic, so that the minimum PWM pulse durations in which the illuminant driver delivers energy to the illuminant at a temporal piece are extended by the low PWM pulse instantaneous frequency. However, changing the PWM period duration is clearly preferable. By lowering the PWM pulse instantaneous frequency in this way, the proportional influence of the edge time can thus be minimized and the time for performing diagnostic functions, such as sensing the voltage drop across the illuminant during the PWM pulse period or sensing the electric current through the illuminant during the PWM pulse period, becomes longer. Thus, it is possible to achieve stabilization of the current through the illuminant or stabilization of the voltage drop across the illuminant before the illuminant driver, for example by means of an analog-to-digital converter of the illuminant driver, performs the measurement during the PWM pulse period outside the edge times in which the control signal changes its voltage or current state. For example, the illuminant driver may have a microcomputer. Preferably, the microcontroller acquires the diagnostic values for the magnitude of the illuminant current and/or the illuminant voltage determined by the analog-to-digital converter during the PWM pulse durations and outside the edge times and outputs them or transmits them, for example, via said data bus or holds them ready for interrogation by the higher-level system. Typically, a means, for example a shunt resistor, for current-to-voltage conversion is connected in series with the illuminant, through which the electrical illuminant current flows, so that the analog-to-digital converter can detect current and voltage in time-division multiplex at its input by means of a multiplexer, at least at times and with a time delay.

The method allows an adaptive PWM pulse instantaneous frequency to improve the diagnosis and dimming of the illuminant, in this case an LED or an LED string or several LED strings. An LED string is understood to be a series connection of several LEDs.

DESCRIPTION

Figure 1:
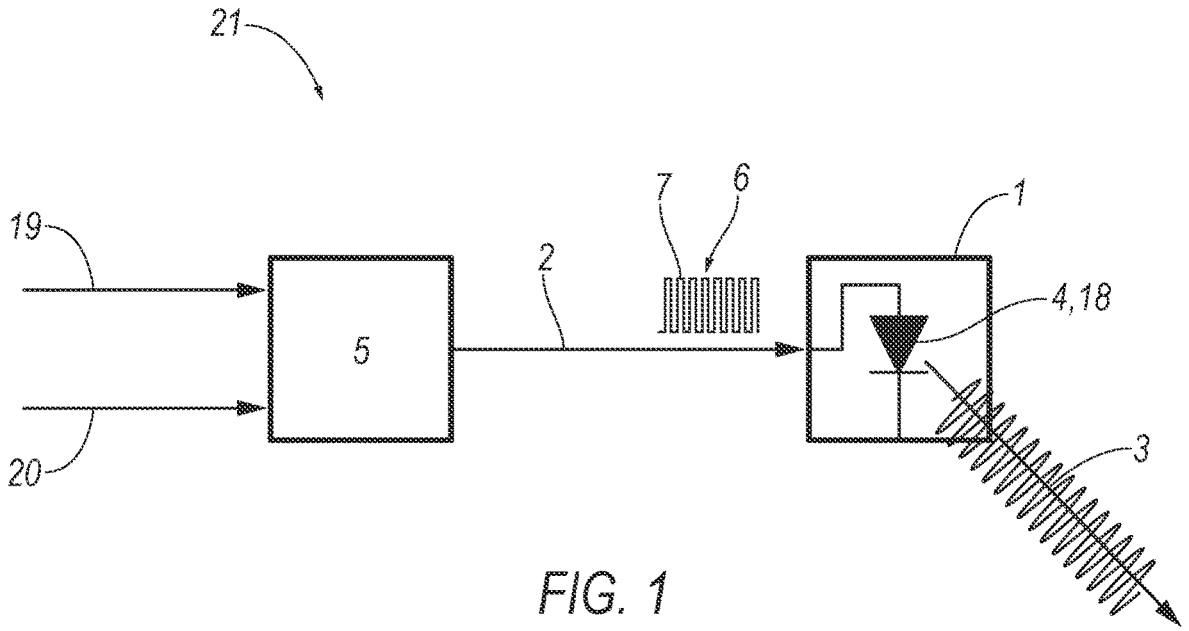
FIG. 1 is a schematic diagram of an example luminaire for implementing PWM light control according to the disclosure.
Figure 2:
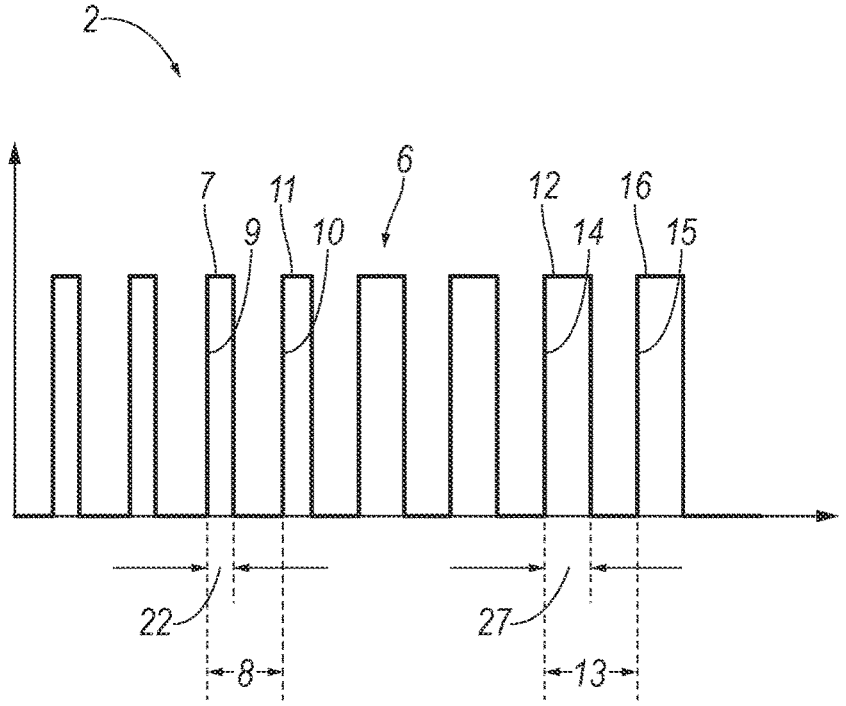
FIG. 2 is an example timing diagram of a control signal for the example luminaire of FIG. 1.

In the following, therefore, a method and a device are proposed which implement this idea. The following description references FIGS. 1 and 2. The proposed method is a method for controlling a light source 1 with a control signal 2. The intensity of the light 3 emitted by the illuminant 4 depends on the value and the value progression of the control signal 2. In this method, the value progression of the control signal 2 is PWM-modulated in time with a PWM modulation 6. This temporal PWM modulation 6 of the control signal 2 has PWM pulses 7, 12 and PWM periods 8, 13 associated with the PWM pulses 7, 12, respectively, as a result of this PWM modulation 6. For purposes of this writing, a PWM period 8, 13 of a PWM pulse 7, 12 begins in time with the rising edge 9, 14 of the PWM pulse and ends in time with the rising edge 10, 15 of the immediately following PWM pulse 11, 16 of the PWM modulation 6. The value of the PWM pulse instantaneous frequency of a PWM pulse 7, 12 is, for the purposes of this document, the reciprocal of the value of the temporal duration of the PWM period 8, 13 of the PWM pulse 7, 12.

As used herein, the PWM duty cycle of a PWM pulse is the ratio of the value of the temporal duration 22, 27 of a PWM pulse 7, 12 in a PWM period 8, 13 of the PWM modulation 6 of the control signal 2 divided by the value of the temporal PWM period duration of that PWM period 8, 13 of the PWM modulation 6 of the control signal 2.

The method is characterized in that the PWM pulse instantaneous frequency of the PWM pulses 7, 12 of the PWM modulation 6 depends on the PWM duty cycle of the PWM pulses 7, 12 of the PWM modulation 6 of the control signal 2. That is, the PWM pulse instantaneous frequency of the PWM pulses 7, 11 of the PWM modulation 6 is a first PWM pulse instantaneous frequency at a first PWM duty cycle of the PWM pulses 7, 11 of the PWM modulation 6 of the control signal 2, and the PWM pulse instantaneous frequency of the PWM pulses 12, 16 of the PWM modulation 6 is a second PWM duty cycle of the PWM pulses 12, 16 of the PWM modulation 6 of the control signal 2, which is different from the first PWM duty cycle, is a second PWM pulse instantaneous frequency which is different from the second PWM pulse instantaneous frequency. In at least one operating condition of the proposed device performing the proposed method, the magnitude of the first PWM duty cycle is less than the magnitude of the second PWM duty cycle. Then, in this very operating condition, the magnitude of the first PWM pulse instantaneous frequency is smaller than the magnitude of the second PWM pulse instantaneous frequency. Preferably, the illuminant comprises at least one LED, LED string or is an LED or LED string.

Corresponding to this method is an associated luminaire 21 comprising a sub-device performing the previously described method. Such a luminaire comprises at least one illuminant 4, an illuminant driver 5 and a control signal 2. The illuminant driver 5 supplies the illuminant 4 with electrical energy at least secondarily via the control signal 2. The illuminant driver 5 generates the control signal 2. The intensity of the light 3 emitted by the illuminant 4 depends on the value and the temporal value progression of the control signal 2. The illuminant driver 5 may, for example, have said microcomputer, which may, for example, receive default values from a higher-level system via a data bus. The temporal value progression of the control signal 2 generated by the illuminant driver 5, and thus the intensity of the light 3 emitted by the illuminant 4, preferably depend on such a preset value 19. This preset value 19 can possibly be generated by the illuminant driver 5 or, for example, received from a higher-level computer system or the like via a data bus and/or, for example, held ready. Preferably, but not necessarily, the preset value 19 is a preset value for the duty cycle. The illuminant driver 5 PWM modulates the duty cycle of the control signal 2 in time with a PWM modulation 6. The PWM modulation 6 of the control signal 2 of the illuminant driver 5 has said PWM pulses 7, 12 in a temporal and typically non-overlapping sequence. The PWM modulation 6 of the illuminant driver 5 further comprises respective PWM periods 8, 13, wherein a respective PWM period 8, 13 is associated with exactly one respective PWM pulse 7, 12 in the sense of this writing. A PWM period 7, 12 of a PWM pulse begins in terms of time with the rising edge 9, 14 of the PWM pulse 7, 12 and ends with the rising edge 10, 15 of the immediately following PWM pulse 11, 16 of the PWM modulation 6. For the purposes of this document, the PWM pulse instantaneous frequency of a PWM pulse 7, 12 is the reciprocal value of the PWM period 8, 13 of the PWM pulse 7, 12.

As used herein, the PWM duty cycle of a PWM pulse 7,12 is the ratio of the value of the temporal duration 22, 27 of a PWM pulse 7, 12 in a PWM period 8, 13 of the PWM modulation 6 of the control signal 2 divided by the value of the temporal PWM period duration of said PWM period 8, 13 of the PWM modulation 6 of the control signal 2. As before, the PWM duty cycle and/or the PWM pulse instantaneous frequency preferably depend on said default value. For a first default value 19, the PWM pulse instantaneous frequency of the PWM pulses 7 of the PWM modulation 6 is a first PWM pulse instantaneous frequency for a first PWM duty cycle of the PWM pulses of the PWM modulation of the control signal. For a second default value 20 different from the first default value, the PWM pulse instantaneous frequency of the PWM pulses 12 of the PWM modulation 6 at a second PWM duty cycle of the PWM pulses 12 of the PWM modulation 6 of the control signal 2 different from the first PWM duty cycle is a second PWM pulse instantaneous frequency different from the first PWM pulse instantaneous frequency.

At least the magnitude of the first PWM duty cycle is thereby smaller than the magnitude of the second PWM duty cycle. In this operating state, the magnitude of the first PWM pulse instantaneous frequency is then smaller than the magnitude of the second PWM pulse instantaneous frequency. Preferably, again, the illuminant comprises at least one LED and/or LED string.

A higher PWM pulse torque approach frequency of the PWM control is made possible. However, the advantages are not limited to this.

What is claimed is:

1. A method of driving a light source (1) with a control signal (2) wherein an intensity of light (3) emitted by an illuminant (4) depends on a value and a value progression of the control signal (2), the method comprising:

modulating the value progression of the control signal (2) in time with a PWM modulation (6), and either:

(a) determining a duty cycle of the PWM modulation of the control signal driving the light source based on a desired light intensity of the illuminant and determining a PWM period of the modulation of the control signal driving the light source based on the determined PWM modulation, or (b) determining the period of the PWM modulation of the control signal driving the light source based on a desired light intensity of the illuminant and determining the duty cycle of the control signal driving the light source based on the determined period of the PWM modulation;

wherein:

the PWM modulation (6) of the control signal comprises PWM pulses;

the PWM modulation (6) further comprises PWM periods respectively associated with the PWM pulses;

a PWM period of a respective PWM pulse begins in time with a rising edge of the PWM pulse and ends with a rising edge of an immediately following PWM pulse of the PWM modulation (6);

a PWM pulse instantaneous frequency of the PWM pulse is a reciprocal of the PWM period of the PWM pulse;

a PWM duty cycle of the PWM pulse is a ratio of a value of a temporal duration of the PWM pulse in the PWM period of the PWM modulation of the control signal divided by a value of a temporal PWM period duration of the PWM period of the PWM modulation of the control signal (2), and further wherein:

an illuminant driver (5) supplies the illuminant (4) with a PWM modulated electric current that is switched on and off according to the PWM modulation of the control signal (2), such that the PWM modulation of the control signal is applied to the illuminant;

the PWM pulse instantaneous frequency of the PWM pulses of the PWM modulation (6) depends on the PWM duty cycle of the PWM pulses of the PWM modulation (6) of the control signal (2);

a PWM pulse instantaneous frequency of PWM pulses of the PWM modulation is a first PWM pulse instantaneous frequency at a first PWM duty cycle of the PWM pulses of the PWM modulation (6) of the control signal (2), and a PWM pulse instantaneous frequency of the PWM pulses of the PWM modulation (6) at a second PWM duty cycle of the PWM pulses of the PWM modulation (6) of the control signal (2), which is different from the first PWM duty cycle, is a second PWM pulse instantaneous frequency which is different from the first PWM pulse instantaneous frequency;

at least in one operating state, a magnitude of the first PWM duty cycle is smaller than a magnitude of the second PWM duty cycle; and in the operating state a magnitude of the first PWM pulse instantaneous frequency is smaller than a magnitude of the second PWM pulse instantaneous frequency.

2. The method according to claim 1, wherein the illuminant (4) comprises at least one LED (18).

3. A luminaire (21) comprising:

an illuminant (4);

an illuminant driver (5); and a control signal (2);

wherein:

the illuminant driver (5) supplies the illuminant (4) with a PWM modulated current that is switched on and off according to a PWM modulation (6) of the control signal (2), such that the PWM modulation of the control signal is applied to the illuminant;

the illuminant driver (5) generates the control signal (2);

an intensity of light (3) emitted by the illuminant (4) depends on a value and a time variation of the control signal (2);

a temporal value progression of the control signal (2) generated by the illuminant driver (5) and thus the intensity of the light (3) emitted by the illuminant (4) depends on a first preset value which the illuminant driver (5) generates or receives or holds ready;

the illuminant driver PWM-modulates the temporal value progression of the control signal (2) in time with the PWM modulation (6);

the PWM modulation (6) of the control signal (2) of the illuminant driver comprises PWM pulses;

the PWM modulation of the illuminant driver (5) comprises PWM periods which are respectively associated with the PWM pulses;

a PWM period of a PWM pulse begins in time with a rising edge of the PWM pulse and ends with a rising edge of an immediately following PWM pulse of the PWM modulation (6);

a PWM pulse instantaneous frequency of the PWM pulse is a reciprocal of the PWM period of the PWM pulse; and a PWM duty cycle of the PWM pulse is a ratio of a value of a temporal duration of the PWM pulse in the PWM period of the PWM modulation (6) of the control signal (2) divided by a value of a temporal PWM period duration of the PWM period of the PWM modulation (6) of the control signal (2);

and further wherein:

either:

(a) the PWM duty cycle is determined based on the first preset value, and the PWM instantaneous frequency is determined based on the determined PWM duty cycle, or (b) the PWM instantaneous frequency is determined based on the first preset value, and the PWM duty cycle is determined based on the PWM instantaneous frequency;

the PWM duty cycle and/or the PWM pulse instantaneous frequency depends on the first preset value;

for a first default value of the first preset value, a PWM pulse instantaneous frequency of the PWM pulses of the PWM modulation is a first PWM pulse instantaneous frequency at a first PWM duty cycle of the PWM pulses of the PWM modulation of the control signal;

for a second value of the first preset value different from the first default value of the first preset value, a PWM pulse instantaneous frequency of the PWM pulses of the PWM modulation at a second PWM duty cycle of the PWM pulses of the PWM modulation of the control signal different from the first PWM duty cycle is a second PWM pulse instantaneous frequency different from the second PWM pulse instantaneous frequency; and at least a magnitude of the first PWM duty cycle is smaller than a magnitude of the second PWM duty cycle; and a magnitude of the first PWM pulse instantaneous frequency is smaller than a magnitude of the second PWM pulse instantaneous frequency.

4. The luminaire (21) according to claim 3, wherein the illuminant (4) comprises at least one LED (18).

5. The luminaire (21) according to claim 3, wherein the illuminant driver (5) includes a current source that is switched on and off according to the PWM modulation (6) of the control signal (2) and supplies PWM electric current to the illuminant (4).

6. The luminaire (21) according to claim 3, wherein the illuminant driver (5) includes a current source that is switched on and off according to the PWM modulation (6) of the control signal (2) and supplies PWM electric current to the illuminant (4).

* * * * *